US007567874B2

(12) United States Patent
Dishongh et al.

(10) Patent No.: US 7,567,874 B2
(45) Date of Patent: Jul. 28, 2009

(54) SYSTEM AND METHOD FOR DETECTING FURNITURE CRUISING FREQUENCY TO MONITOR GAIT DECLINE

(75) Inventors: Terrance Dishongh, Portalnd, OR (US); Cliodhna Ni Scanaill, Co. Chorcai (IE); Karol O'Donovan, Co. Cork (IE)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/863,408

(22) Filed: Sep. 28, 2007

(65) Prior Publication Data

US 2009/0088986 A1 Apr. 2, 2009

(51) Int. Cl.
*G01L 1/00* (2006.01)
*G08B 23/00* (2006.01)

(52) U.S. Cl. ..... 702/42; 340/573.4

(58) Field of Classification Search ..... 702/42, 702/41, 65, 127, 139, 175, 188; 700/9, 69; 73/865.4; 340/573.1, 573.4
See application file for complete search history.

(56) References Cited

U.S. PATENT DOCUMENTS 7,346,464 B2 * 3/2008 Takiguchi ..... 702/70
2007/0233403 A1 * 10/2007 Alwan et al. ..... 702/33
2008/0186189 A1 * 8/2008 Azzaro et al. ..... 340/573.7
2008/0281550 A1 * 11/2008 Hogle et al. ..... 702/127

OTHER PUBLICATIONS

Scanaill et al., A Review of Approaches to Mobility Telemonitoring of the Elderly in Their Living Environment, Apr. 2006, Annuals of Biomedical Engineering, vol. 34, No. 4, pp. 547-563.*

* cited by examiner

*Primary Examiner*—Michael P. Nghiem
*Assistant Examiner*—Toan M Le
(74) *Attorney, Agent, or Firm*—Molly A. McCall

(57) ABSTRACT

A system and method for detecting furniture cruising frequency to monitor gait decline. Embodiments of the invention monitor the frequency of furniture cruising in one's home in such a way that it does not require daily user intervention to operate. Here, shock sensors are attached or integrated into furniture in the normal walking paths for an individual in his or her home. Through the use of these shock sensors, embodiments of the invention are able to monitor the frequency of furniture cruising for the individual. If the frequency of furniture cruising exceeds a certain threshold, an assistive support device such as a walking stick or a walking frame may be required for the individual. Other embodiments are described and claimed.

12 Claims, 4 Drawing Sheets

400

SYSTEM AND METHOD FOR DETECTING FURNITURE CRUISING FREQUENCY TO MONITOR GAIT DECLINE

BACKGROUND

Ethnographic research has shown that elderly people use the furniture around them to support their movement as they move from one location in their home to another. Such a dependence on furniture to move around may be referred to as furniture cruising. An increase in furniture cruising may indicate that an individual is experiencing balance or gait difficulties (i.e., gait decline). Gait decline may indicate an increased tendency to falling. One method of monitoring in-home gait decline in an individual is via the individual wearing inertial sensors all day, everyday, which may lead to compliance problems.

DETAILED DESCRIPTION

Various embodiments of the present invention may be generally directed to a system and method for detecting furniture cruising frequency to monitor gait decline. Embodiments of the invention measure the frequency of furniture cruising in one's home in such a way that it does not require daily user intervention to operate. The measurement of furniture cruising frequency can indicate the level of dependence of the individual (generally an elderly person) on furniture to support his or her movement from one area to another in the home.

In embodiments, shock sensors are attached or integrated into furniture in the normal walking paths for an individual in his or her home. Through the use of these shock sensors, embodiments of the invention are able to monitor the frequency of furniture cruising for the individual. If the frequency of furniture cruising exceeds a certain threshold, the individual may be experiencing a gait decline. Here, an assistive support device such as a walking stick or a walking frame may be required for the individual. Other embodiments may be described and claimed.

Various embodiments may comprise one or more elements or components. An element may comprise any structure arranged to perform certain operations. Each element may be implemented as hardware, software, or any combination thereof, as desired for a given set of design parameters or performance constraints, Although an embodiment may be described with a limited number of elements in a certain topology by way of example, the embodiment may include more or less elements in alternate topologies as desired for a given implementation. It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
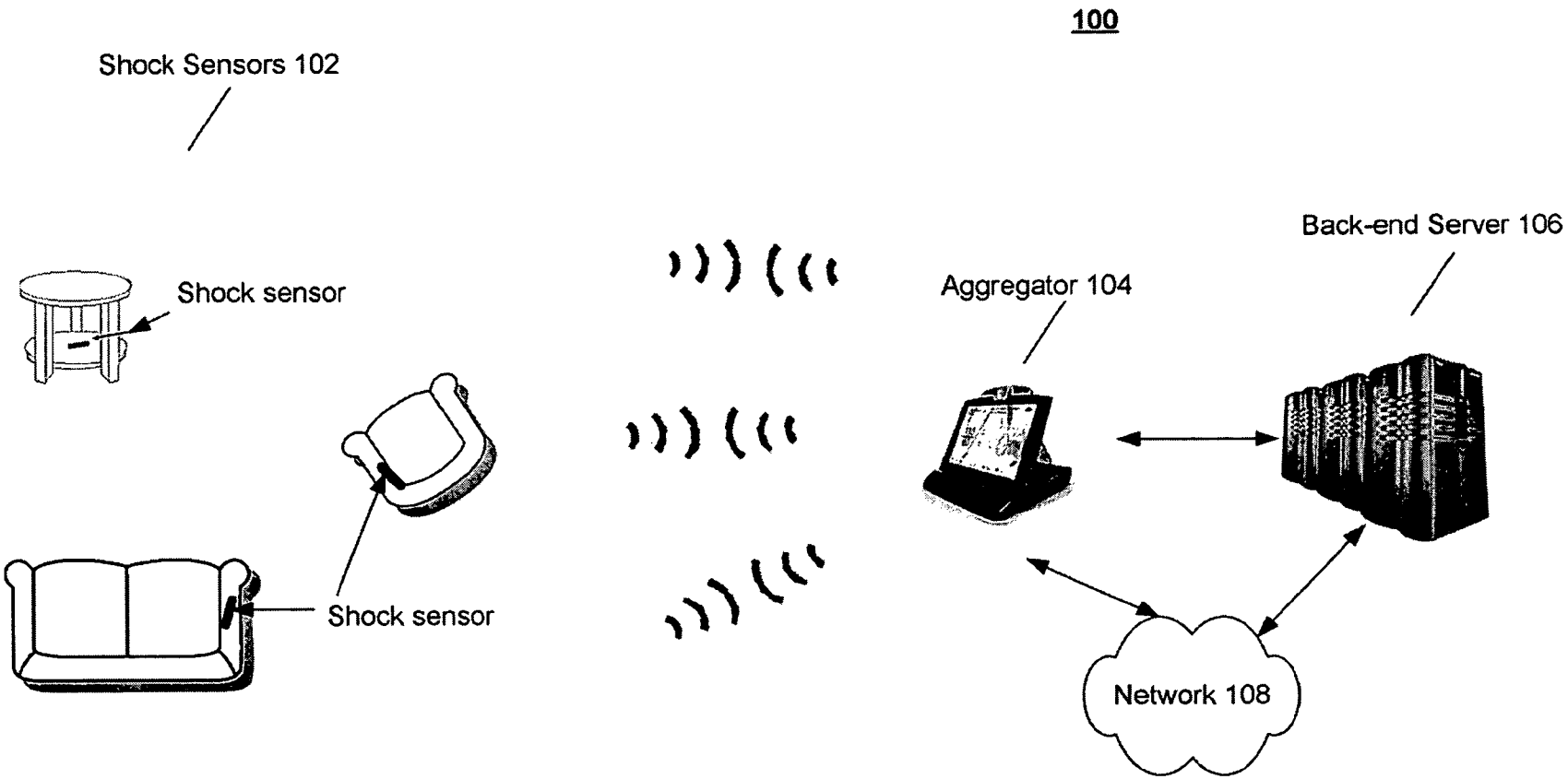
FIG. 1 illustrates one embodiment of a system for detecting furniture cruising frequency to monitor gait decline.

FIG. 1 illustrates one embodiment of a system 100 for detecting furniture cruising frequency to monitor gait decline. In one embodiment, process 100 comprises one or more shock sensors 102, a device or aggregator 104, a back-end server 106 and a network 108. Each of these components is described next in more detail.

In embodiments, shock sensors 102 are incorporated into furniture in the normal walking paths for an individual in his or her home. The trigger point for each shock sensor 102 is adjusted according to the size and/or weight of the furniture to which it is associated or attached. The adjustment of the trigger point may be needed because using a heavier piece of furniture for support as one walks generally results in a lighter shock to that piece of furniture than it would to a lighter piece of furniture. Embodiments of the invention may use a similar shock-detection technology that is used in car alarm systems.

Each time a shock is detected by one of sensors 102, a message is sent to aggregator 104. In embodiments, the message indicates to aggregator 104 that the individual just used the particular piece of furniture for support while walking.

One or more of shock sensors 102 may be connected directly to aggregator 104. Here, an A/D conversion of the message may be accomplished via an A/D converter in aggregator 104. The collected data may also be wirelessly transmitted to aggregator 104 via, for example, Bluetooth technology, Zigbee technology or a proprietary system. In an embodiment, the A/D conversion of the collected data may be accomplished via an A/D converter in the sensor itself. In an embodiment, the converted data may be transferred via a radio in the sensor to a radio in aggregator 104. The invention is not limited to these example wireless technologies/examples. Alternatively, sensors 102 may transmit data to aggregator 104 via some combination of wireless and wired connection technologies.

Messages from shock sensors 102 may be sent to aggregator 104 in real-time. Sensors 102 may also be adapted to store the messages via integrated long term storage, such as flash memory for example, and then to transmit the messages to aggregator 104 at a later time. The integrated long term storage helps to ensure that no messages are lost if there is no connection currently available with aggregator 104.

Aggregator 104 receives the messages from shock sensors 102. Aggregator 104 collects all of the messages and calculates the individual's Gait Index (GI). The Gait Index can be studied for daily patterns of furniture cruising frequency and for long-term increases in furniture cruising frequency. The Gait Index can be calculated by using the following formula, where GI is the daily gait index and $M_I$ is the number of shocks detected by sensors 102 between 6 am and 12 am:

$$GI = \sum_{i=6am}^{12am} M_1$$

Figure 2:
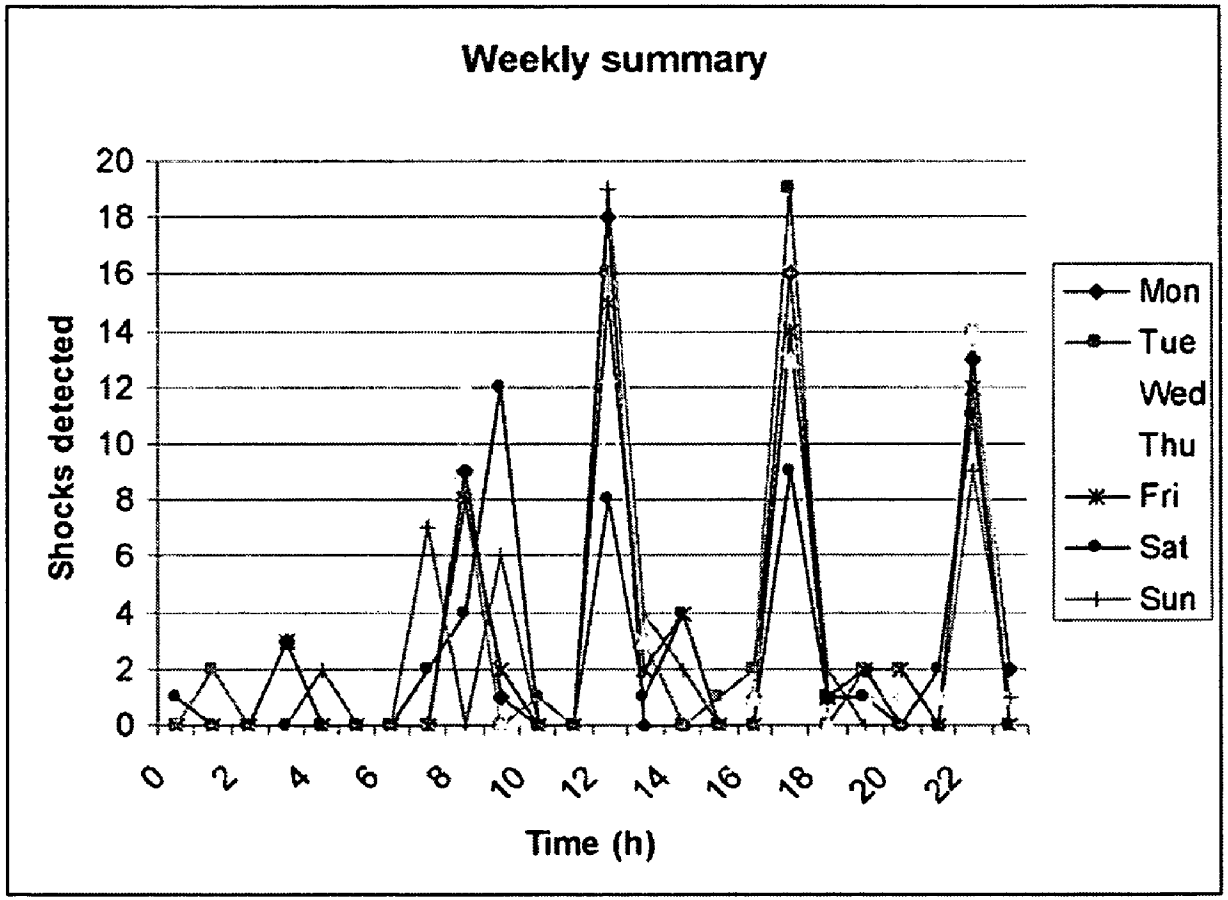
FIG. 2 illustrates an example day-by-day chart to monitor the number of shocks detected in furniture for an individual.
Figure 3:
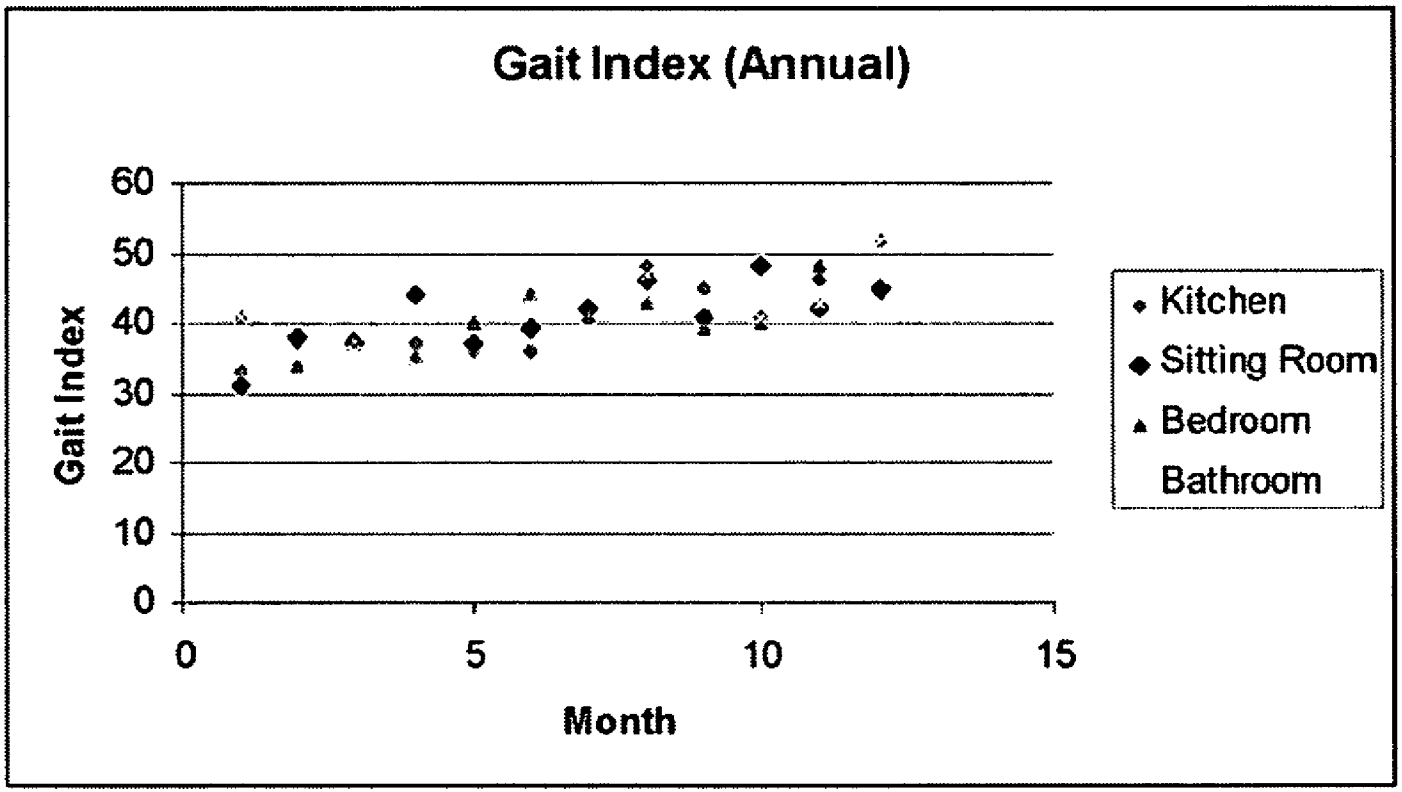
FIG. 3 illustrates an example annual view of a gait index for each room in the home of the individual.

The Gait Index can be plotted against time to create day-to-day ADL plots, as illustrated in FIG. 2. The Gait Index can also be plotted against time to create month-by-month gait dependence plots, as illustrated in FIG. 3.

Aggregator 104 may transmit all of the data related to the individual to back-end server 106 for further analysis by the individual's physician, for example. The data may be transmitted via network 108 (e.g., the Internet, a local area network (LAN), a wide area network (WAN), etc.) or via a direct connection between aggregator 104 and back-end server 106 or a connection that involves a combination of wireless and wired technologies.

In one embodiment, aggregator 104 may be any device capable of performing the functionality of the invention described herein. Aggregator 104 may be implemented as part of a wired communication system, a wireless communication system, or a combination of both. In one embodiment, for example, aggregator 104 may be implemented as a mobile computing device having wireless capabilities. A mobile computing device may refer to any device having a processing system and a mobile power source or supply, such as one or more batteries, for example.

Examples of embodiments of a mobile computing device that may be adapted to include the functionality of the present invention include a laptop computer, ultra-laptop computer, portable computer, handheld computer, palmtop computer, personal digital assistant (PDA), cellular telephone, combination cellular telephone/PDA, smart phone, pager, one-way pager, two-way pager, messaging device, data communication device, and so forth.

Examples of such a mobile computing device also may include computers that are arranged to be worn by a person, such as a wrist computer, finger computer, ring computer, eyeglass computer, belt-clip computer, arm-band computer, shoe computers, clothing computers, and other wearable computers.

In various embodiments, system 100 may be implemented as a wireless system, a wired system, or a combination of both. When implemented as a wireless system, system 100 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 100 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Operations for the above embodiments may be further described with reference to the following figures and accompanying examples. Some of the figures may include a logic flow. Although such figures presented herein may include a particular logic flow, it can be appreciated that the logic flow merely provides an example of how the general functionality as described herein can be implemented. Further, the given logic flow does not necessarily have to be executed in the order presented unless otherwise indicated. In addition, the given logic flow may be implemented by a hardware element, a software element executed by a processor, or any combination thereof.

Figure 4:
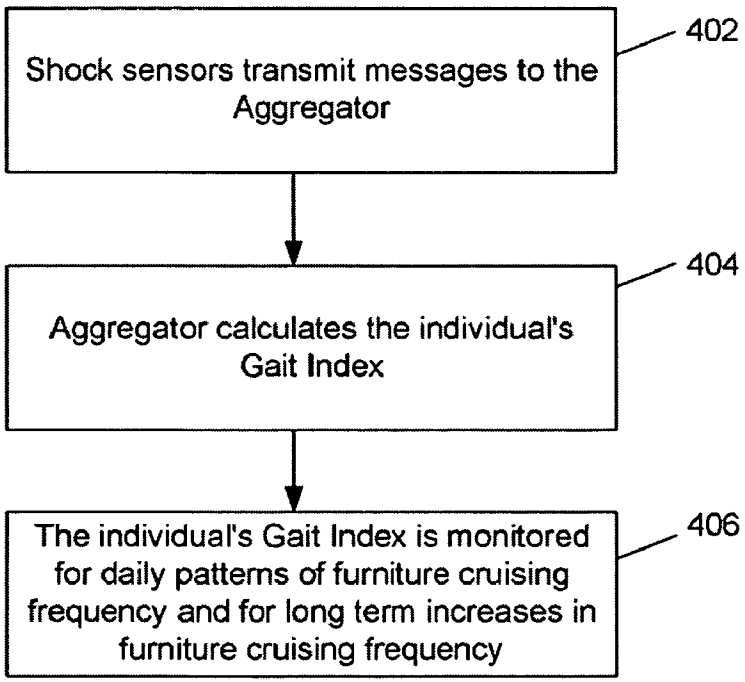
FIG. 4 illustrates one embodiment of a logic flow for detecting furniture cruising frequency to monitor gait decline.

FIG. 4 illustrates one embodiment of a logic flow 400 for detecting furniture cruising frequency to monitor gait decline. The logic flow 400 may be representative of the operations executed by one or more embodiments described herein, for example, the operations executed by system 100.

Referring to FIG. 4, shock sensors 102 transmit messages to aggregator 104 each time a shock is detected by one of the sensors (block 402). In embodiments, the message indicates to aggregator 104 that the individual just used the particular piece of furniture for support while walking. Aggregator 104 collects all of the messages and calculates the individual's Gait Index (block 404). The Gait Index is monitored for daily patterns of furniture cruising frequency and for long-term increases in furniture cruising frequency (block 406). If the frequency of furniture cruising exceeds a certain threshold, the individual may be experiencing a gait decline. Here, an assistive support device such as a walking stick or a walking frame may be required for the individual.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable or computer-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A system, comprising:

at least one shock sensor, wherein the at least one shock sensor is associated with furniture in the normal walking path of an individual; and a device to receive one or more messages from the at least one shock sensor each time a shock is detected, wherein the device to use the one or more messages to determine a furniture cruising frequency for the individual, wherein the device to calculate a Gait Index for the individual based on the one or more messages and wherein the device to monitor the Gait Index for daily patterns of the furniture cruising frequency.

2. The system of claim 1, wherein the device to monitor the Gait Index for long-term increases in the furniture cruising frequency.

3. The system of claim 1, wherein the furniture cruising frequency exceeding a threshold indicates that the individual is experiencing a gait decline.

4. The system of claim 1, where the at least one shock sensor is adjusted based on a weight of its associated furniture.

5. A method, comprising:

associating at least one shock sensor with furniture in the normal walking path of an individual;

receiving one or more messages from the at least one shock sensor each time a shock is detected;

using the one or more messages to determine a furniture cruising frequency for the individual;

calculating a Gait Index for the individual based on the one or more messages; and monitoring the Gait Index for daily patterns of the furniture cruising frequency.

6. The method of claim 5, further comprising:

monitoring the Gait Index for long-term increases in the furniture cruising frequency.

7. The method of claim 5, wherein the furniture cruising frequency exceeding a threshold indicates that the individual is experiencing a gait decline.

8. The method of claim 5, further comprising:

adjusting the at least one shock sensor based on a weight of its associated furniture.

9. A machine-readable medium containing instructions which, when executed by a processing system, cause the processing system to perform a method, the method comprising:

associating at least one shock sensor with furniture in the normal walking path of an individual;

receiving one or more messages from the at least one shock sensor each time a shock is detected;

using the one or more messages to determine a furniture cruising frequency for the individual;

calculating a Gait Index for the individual based on the one or more messages; and monitoring the Gait Index for daily patterns of the furniture cruising frequency.

10. The machine-readable medium of claim 9, further comprising:

monitoring the Gait Index for long-term increases in the furniture cruising frequency.

11. The machine-readable medium of claim 9, wherein the furniture cruising frequency exceeding a threshold indicates that the individual is experiencing a gait decline.

12. The machine-readable medium of claim 9, further comprising:

adjusting the at least one shock sensor based on a weight of its associated furniture.

* * * * *